US012669256B2

(12) United States Patent
Tao et al.

(10) Patent No.: US 12,669,256 B2
(45) Date of Patent: Jun. 30, 2026

(54) METHOD FOR CONTROLLING VARIABLE REFRIGERANT FLOW AIR CONDITIONER, VARIABLE REFRIGERANT FLOW AIR CONDITIONER, AND STORAGE MEDIUM

(71) Applicant: GD MIDEA AIR-CONDITIONING EQUIPMENT CO., LTD., Foshan (CN)

(72) Inventors: Kui Tao, Foshan (CN); Dawei Zhuang, Foshan (CN); Zhigang Huang, Foshan (CN); Haomin Cao, Foshan (CN); Guoliang Ding, Foshan (CN); Shunquan Li, Foshan (CN); Hao Zhang, Foshan (CN)

(73) Assignee: GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 205 days.

(21) Appl. No.: 18/417,180

(22) Filed: Jan. 19, 2024

(65) Prior Publication Data

US 2024/0159423 A1 May 16, 2024

Related U.S. Application Data

(63) Continuation of application No. PCT/CN2022/082484, filed on Mar. 23, 2022.

(30) Foreign Application Priority Data

Jul. 20, 2021 (CN) ..... 202110821933.7

(51) Int. Cl.
*F24F 11/84* (2018.01)
*F24F 11/64* (2018.01)
(Continued)

(52) U.S. Cl.
CPC ..... *F24F 11/84* (2018.01); *F24F 11/64* (2018.01); *F24F 11/85* (2018.01);
(Continued)

(58) Field of Classification Search
CPC .. F24F 11/84; F24F 11/85; F24F 11/64; F24F 2140/50; F24F 2110/12; F24F 2140/20
See application file for complete search history.

(56) References Cited

U.S. PATENT DOCUMENTS

2006/0107683 A1* 5/2006 Song ..... F25B 25/005 62/434
2016/0131384 A1* 5/2016 Yoon ..... F25B 49/022 700/278
2016/0200176 A1 7/2016 Stanke et al.

FOREIGN PATENT DOCUMENTS

CN 1128340 A 8/1996
CN 103162385 A 6/2013
(Continued)

OTHER PUBLICATIONS

For3, Control Method, Device and Air Conditioner of Electronic Expansion Valve in Air Conditioner, 2021, Full Document (Year: 2021).*

(Continued)

*Primary Examiner* — Nael N Babaa
(74) *Attorney, Agent, or Firm* — SCULLY, SCOTT, MURPHY & PRESSER, P.C.

(57) ABSTRACT

Disclosed are a method for controlling a variable refrigerant flow (VRF) air conditioner, a VRF air conditioner, and a computer-readable storage medium. The method includes: obtaining a target indoor unit in a warming stage among started indoor units; determining a target superheat degree according to a working condition parameter of the target indoor unit; and adjusting an operating parameter of an
(Continued)

electronic expansion valve of the target indoor unit according to the target superheat degree.

14 Claims, 3 Drawing Sheets

(51) Int. Cl.
*F24F 11/85* (2018.01)
*F24F 110/12* (2018.01)
*F24F 140/20* (2018.01)
*F24F 140/50* (2018.01)

(52) U.S. Cl.
CPC ..... *F24F 2110/12* (2018.01); *F24F 2140/20* (2018.01); *F24F 2140/50* (2018.01)

(56) References Cited

FOREIGN PATENT DOCUMENTS

| | | | | | |
|---|---|---|---|---|---|
| CN | 107781919 | A | * | 3/2018 | ..... F24F 1/58 |
| CN | 109751738 | A | | 5/2019 | |
| CN | 109751740 | A | | 5/2019 | |
| CN | 110579046 | A | | 12/2019 | |
| CN | 110715466 | A | | 1/2020 | |
| CN | 111578472 | A | | 8/2020 | |
| CN | 111578482 | A | | 8/2020 | |
| CN | 111928435 | A | | 11/2020 | |
| CN | 112628984 | A | * | 4/2021 | ..... F24F 11/84 |
| CN | 112710064 | A | | 4/2021 | |
| CN | 112710066 | A | | 4/2021 | |
| CN | 113531857 | A | | 10/2021 | |
| EP | 0692683 | A2 | | 1/1996 | |
| GB | 2287783 | A | | 9/1995 | |
| WO | 2020101176 | A1 | | 5/2020 | |

OTHER PUBLICATIONS

For4, Outdoor Machine of Air Conditioner, Air Conditioner and Controlling Method for Air Conditioner, 2018, Full Document (Year : 2018).*

Supplementary European Search Report dated Apr. 23, 2024 received in European Patent Application No. EP 22844872.6.

Notification to Grant Patent Right for Invention dated Aug. 24, 2022 received in Chinese Patent Application No. CN 202110821933.7.

International Search Report and Written Opinion dated Jun. 23, 2022 received in International Application No. PCT/CN2022/082484.

* cited by examiner

METHOD FOR CONTROLLING VARIABLE REFRIGERANT FLOW AIR CONDITIONER, VARIABLE REFRIGERANT FLOW AIR CONDITIONER, AND STORAGE MEDIUM

CROSS-REFERENCE TO RELATED APPLICATIONS

This application is a continuation application of PCT International Application No. PCT/CN2022/082484, filed on Mar. 23, 2022, which claims priority to Chinese Patent Application No. 202110821933.7, filed on Jul. 20, 2021, the entire contents of each of which are incorporated herein by reference for all purposes. No new matter has been introduced.

FIELD

The present application relates to the field of variable refrigerant flow (VRF) air conditioners, and in particular, to a method for controlling a VRF air conditioner, a VRF air conditioner, and a computer-readable storage medium.

BACKGROUND

The variable refrigerant flow (VRF) air conditioner includes a plurality of indoor units. When controlling the operation of the plurality of indoor units, a fixed superheat degree is used to control the operation of each indoor unit. Different indoor units may be in different operating stages. Taking the cooling mode as an example, some indoor units may be in the cooling stage, another part of the indoor units may be in the warming stage. Since the indoor ambient temperature has reached the indoor set temperature, the indoor units in the warming stage are still controlled according to the same superheat degree as the indoor units in the cooling stage, the cooling capacity output is large. However, since the indoor ambient temperature has reached the indoor set temperature, excessive cooling capacity is not needed. In fact, part of the energy consumed to generate and output this part of the cooling capacity is wasted, which does not match the operation requirements of the indoor units. Therefore, the above method includes at least the following technical problems: when using a fixed superheat degree to control the indoor units in the warming stage, there is a problem that the superheat degree does not match the actual operation requirements of the indoor units.

SUMMARY

The main purpose of the present application is to at least provide a method for controlling a variable refrigerant flow (VRF) air conditioner, a VRF air conditioner, and a computer-readable storage medium, aiming to solve at least the technical problem that when using a fixed superheat degree to control the indoor units in the warming stage, there is a problem that the superheat degree does not match the actual operation requirements of the indoor units.

In order to achieve the above objectives, the present application provides a method for controlling a VRF air conditioner, including:

obtaining a target indoor unit in a warming stage among started indoor units;

determining a target superheat degree according to a working condition parameter of the target indoor unit; and adjusting an operating parameter of an electronic expansion valve of the target indoor unit according to the target superheat degree.

In an embodiment, the obtaining the target indoor unit in the warming stage among the started indoor units includes:

obtaining an indoor ambient temperature of an environment where the started indoor units are located; and determining the indoor unit with the indoor ambient temperature less than or equal to a preset temperature as the target indoor unit at a warming stage, the preset temperature is greater than a set temperature corresponding to the indoor unit.

In an embodiment, after the adjusting the operating parameter of the electronic expansion valve of the target indoor unit according to the target superheat degree, the method further includes:

obtaining a current indoor ambient temperature of the target indoor unit; and in response to determining that the current indoor ambient temperature is within a preset temperature range, closing the electronic expansion valve of the target indoor unit, the set temperature of the target indoor unit is within the temperature range, and the temperature range is obtained according to the set temperature.

In an embodiment, after the adjusting the operating parameter of the electronic expansion valve of the target indoor unit according to the target superheat degree, the method further includes:

obtaining a current indoor ambient temperature of all the started indoor units;

in response to determining that the current indoor ambient temperatures of all the started indoor units are within a corresponding preset temperature range, controlling the started VRF air conditioner to standby, each indoor unit corresponds to one preset temperature range, the set temperature of each indoor unit is within the corresponding preset temperature range, and the preset temperature range is obtained according to the corresponding set temperature;

determining a capability requirement in all indoor units of the VRF air conditioner; and in response to determining that the indoor unit including the capability requirement exists, returning to the obtaining the indoor ambient temperature corresponding to the started indoor unit.

In an embodiment, the step of determining the capability requirement in all indoor units of the VRF air conditioner includes:

determining a cold load and a sensible heat load corresponding to each indoor unit, the cold load is heat carried away from a room required to maintain the indoor ambient temperature, and the sensible heat load is a cold load generated by removing sensible heat through reducing the indoor ambient temperature; and determining the capability requirement of all indoor units according to the cold load and the sensible heat load corresponding to all indoor units, the corresponding indoor unit has the capability requirement when a sum of the cold load and the sensible heat load is greater than zero.

In an embodiment, the step of determining the target superheat degree according to the working condition parameter of the target indoor unit includes:

determining a capability requirement ratio of the target indoor unit according to the working condition parameter, the capability requirement ratio is a ratio of an actual capability requirement to a rated nominal capability; and determining the target superheat degree according to the capability requirement ratio, the indoor ambient temperature of the environment where the target indoor unit is located, the outdoor ambient temperature, and a target evaporation temperature of the target indoor unit, the target superheat degree is positively correlated with the capability requirement ratio.

In an embodiment, the step of adjusting the operating parameter of the electronic expansion valve of the target indoor unit according to the target superheat degree includes:

determining an actual superheat degree of the target indoor unit according to a difference between an outlet temperature of a heat exchanger of the target indoor unit and a middle temperature of the heat exchanger;

determining an operating opening degree and an operating duration of the electronic expansion valve of the target indoor unit according to the difference between the actual superheat degree and the target superheat degree; and controlling the electronic expansion valve of the target indoor unit to operate for the operating duration according to the operating opening degree.

In an embodiment, the method for controlling the VRF air conditioner further includes:

in response to determining that the target indoor unit in the warming stage exists among the started indoor unit, determining a target operating frequency according to a target evaporation temperature of the started indoor unit; and controlling a compressor to operate according to the target operating frequency.

In an embodiment, the step of determining the target operating frequency according to the target evaporation temperature of the started indoor unit includes:

obtaining a minimum target evaporation temperature in the target evaporation temperature of all the started indoor units;

determining an average value of the central temperatures of the heat exchangers of all the started indoor units;

determining a difference between the average value and the minimum target evaporation temperature; and determining the target operating frequency corresponding to the difference.

In an embodiment, after the step of obtaining the target indoor unit in the warming stage among the started indoor units, the method further includes:

periodically detecting an outlet temperature of an outdoor heat exchanger of the target indoor unit; and adjusting a rotating speed of an outdoor fan of the target indoor unit according to the outlet temperature.

Moreover, in order to achieve the above objectives, the present application further provides a VRF air conditioner, including a memory, a processor, and a program for controlling the VRF air conditioner stored in the memory and executable on the processor. When the program for controlling the VRF air conditioner is executed by the processor, the method for controlling the VRF air conditioner as mentioned above is implemented.

Moreover, in order to achieve the above objectives, the present application further provides a computer-readable storage medium. A program, including a set of instructions, for controlling the VRF air conditioner is stored in the computer-readable storage medium, and when the program for controlling the VRF air conditioner is executed by a processor, the method for controlling the VRF air conditioner as mentioned above is implemented.

The method for controlling the VRF air conditioner, the VRF air conditioner, and the computer-readable storage medium provided by the present application, by obtaining the target indoor unit in the warming stage among the started indoor units, the target superheat degree is determined according to the working condition parameters of the target indoor unit, and the operation parameters of the electronic expansion valve of the target indoor unit is adjusted according to the target superheat degree. When the target indoor unit is in the warming stage, in order to avoid the problem of mismatching the actual operation requirements of the indoor unit caused by adopting the same fixed superheat degree in the cooling stage, the target superheat degree is determined through the working condition parameters of the target indoor unit. As the specific information in the working condition parameters of the indoor unit changes during the warming stage, the target superheat degree changes accordingly, and the operating parameters of the electronic expansion valve are adjusted based on the target superheat degree, since the working condition parameters can reflect the actual operation requirements of the indoor unit, the target superheat degree obtained based on the working condition parameters meets the actual operation requirements of the indoor unit. When adjusting the electronic expansion valve of the target indoor unit based on the target superheat degree, the superheat degree is matched with the actual operation requirement of the indoor units.

The realization of the objective, functional characteristics, and advantages of the present application are further described with reference to the accompanying drawings.

DETAILED DESCRIPTION OF EMBODIMENTS

It should be understood that the embodiments described here are only used to explain the present application and are not intended to limit the present application.

Figure 1:
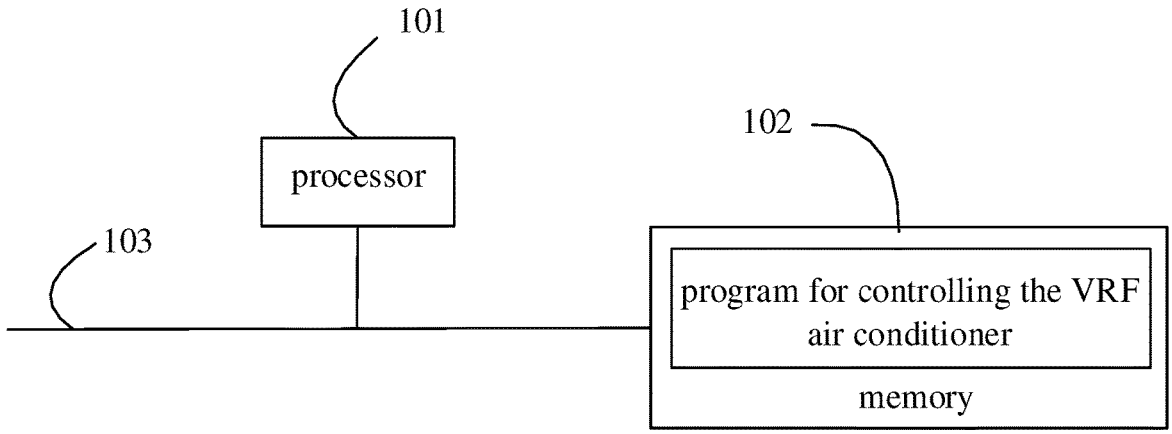
FIG. 1 is a schematic structural diagram of a variable refrigerant flow (VRF) air conditioner according to an embodiment of the present application.

As an embodiment, the hardware structure associated with a method for controlling a variable refrigerant flow (VRF) air conditioner may be shown in FIG. 1.

In an embodiment, the VRF air conditioner may include: at least one processor 101, such as, a central processing unit (CPU), at least one memory 102, a communication bus 103. The communication bus 103 is configured to realize connection communication between these components. The processor 101 is configured to call the computer program to execute a function for controlling the VRF air conditioner.

The memory 102 may be a high-speed random-access memory (RAM) or a non-volatile memory (NVM), such as, a disk memory.

It can be understood that, in an embodiment, the control program for controlling the VRF air conditioner is stored in the memory 102 of the air conditioner. When the processor 101 calls the control program from the memory 102, the following operations are performed:

- obtaining a target indoor unit in a warming stage of started indoor units;
- determining a target superheat degree according to a working condition parameter of the target indoor unit; and
- adjusting an operating parameter of an electronic expansion valve of the target indoor unit according to the target superheat degree.

In another embodiment, the control program that implements the control process of the VRF air conditioner is stored in a computer-readable storage medium. In the process of controlling the VRF air conditioner, the processor 101 of the VRF air conditioner can call the control program from the computer-readable storage medium to perform the above operations.

Based on the hardware structure of the VRF air conditioner mentioned above, various embodiments of the method for controlling the VRF air conditioner of the present application are provided to realize the control of the VRF air conditioner, respectively.

Figure 2:
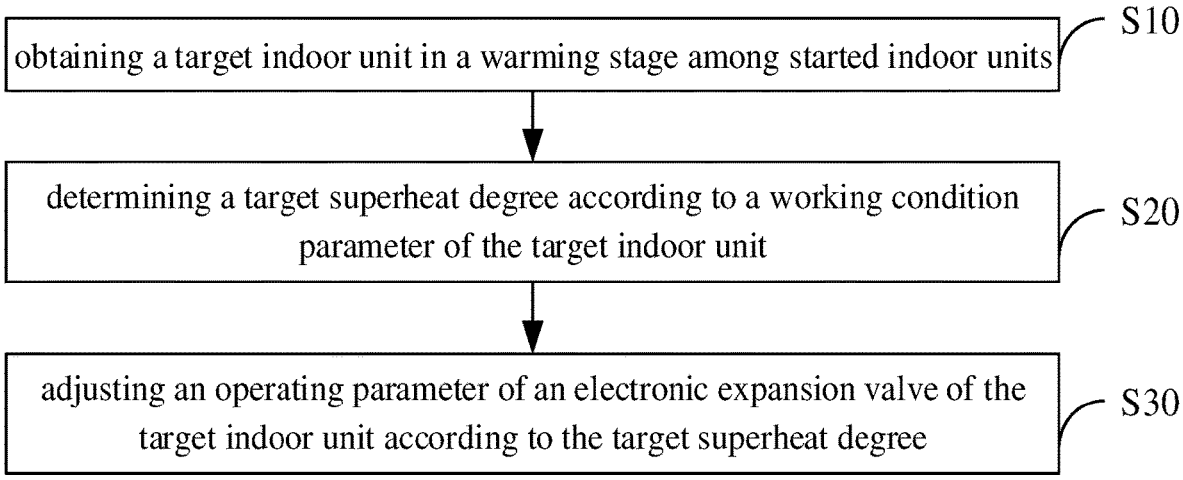
FIG. 2 is a schematic flowchart of a method for controlling the VRF air conditioner according to an embodiment of the present application.

In an embodiment, referring to FIG. 2, the method for controlling the VRF air conditioner provided in this embodiment includes the following steps:

- Step S10, obtaining a target indoor unit in a warming stage among started indoor units;
- Step S20, determining a target superheat degree according to a working condition parameter of the target indoor unit;
- Step S30, adjusting an operating parameter of an electronic expansion valve of the target indoor unit according to the target superheat degree.

The execution subject of the embodiment is a VRF air conditioner; the VRF air conditioner includes at least one outdoor unit and at least two indoor units; the target indoor unit is a started indoor unit in the warming stage.

Different indoor units may be in different rooms. For indoor units in different rooms, the stage they are in after being started may change. Taking the cooling mode as an example, the indoor unit may be in the initialization stage, cooling stage, or warming stage at different moments, where:

In the initialization stage, after being started, the VRF air conditioner will adjust the operating frequency of the compressor to the initial frequency. That is, the stage from starting to the operating frequency reaching the initial frequency is the initialization stage. The initial frequency can be calculated by the following formula:

$$F_0=\mathrm{Cool}_A*Q_{rated}*k_{T1}*k_{fan}*k_{\Delta T}+T4_\mathrm{Freq_Cool}+k_1;$$

$F_0$ represents the initial operating frequency, the unit is Hz, $\mathrm{Cool}_A$ represents the correction coefficient of the capacity requirement, and the value is 4. $Q_{rated}$ represents the rated nominal capacity of the indoor unit, and the unit is kW. $k_{T1}$ represents the correction coefficient of the indoor ambient temperature. $k_{fan}$ represents the correction coefficient of the indoor fan setting gear. $k_{\Delta T}$ represents the temperature difference correction coefficient. T4_Freq_Cool represents the correction coefficient of the outdoor ambient temperature. $k_1$ represents the real-time correction parameter of the initial operating frequency, and the default value is 0. The temperature difference correction coefficient is calculated based on the following formula:

$$k_{\Delta T}=\begin{cases}1, & T_0-T_s\le 6\\ 0.125\cdot(T_0-T_s)+0.25, & 6<T_0-T_s\le 10\\ 1.5, & T_0-T_s>10\end{cases};$$

$T_0$ represents the initial temperature of the room when started, the unit is ° C., and $T_s$ represents the set temperature of the room, the unit is ° C.

The cooling stage refers to the stage from when the operating frequency of the compressor reaches the initial frequency to the stage before entering the warming stage. Specifically, the cooling stage can be from when the operating frequency of the compressor reaches the initial frequency to when the room temperature drops to the set temperature, or it can also be the stage from when the operating frequency of the compressor reaches the initial frequency to when the room temperature drops to the preset temperature. The preset temperature is greater than the set temperature, that is, before the room temperature reaches the set temperature, entering the warming stage; in the cooling stage, the compressor operates at the initial frequency, and the superheat degree set by the electronic expansion valve of the indoor unit is a fixed superheat degree. The fixed superheat degree is, for example, set to 1° C. The range of fixed superheat degree is generally within 0.5° C. to 3° C., according to the relationship between the fixed superheat degree and the preset superheat degree and the operating opening degree of the electronic expansion valve, the operating opening degree used to control the electronic expansion valve can be obtained, and the action cycle corresponding to the operating opening degree and the fixed degree of superheat degree can also be obtained. The action cycle is the length of time that the operating opening degree is maintained. When the fixed degree of superheat degree is used, the opening degree of the electronic expansion valve corresponding to the indoor unit is constant, the amount of cooling delivered is also constant, and the corresponding part of the energy consumption is also constant.

The warming stage refers to the stage when the indoor ambient temperature reaches the set temperature. For example, the indoor ambient temperature drops to the set temperature. In an embodiment the warming stage can also refer to the stage when the indoor ambient temperature reaches the preset temperature. The preset temperature is greater than the set temperature. The set temperature refers to the set temperature of the indoor unit, and the preset temperature is a temperature parameter used to indicate early exit from the cooling stage and entering the warming stage. The operation requirements of the indoor unit in the warming stage are different from those in the cooling stage. The operation requirements of indoor units are different. The indoor unit in the warming stage requires less cooling capacity since the indoor ambient temperature has reached the required ambient temperature. In the actual operation requirements of the indoor unit: the requirement for superheat degree is not a fixed superheat degree, but a superheat degree that can be changed based on actual working conditions. However, the indoor unit in the cooling stage requires more cooling capacity since the indoor ambient temperature has not reached the required temperature, when more cooling capacity are required. In the corresponding actual operation requirements, the requirements of the superheat degree are fixed, for example, the superheat degree is fixed at 1° C. When the exemplary technology controls the target indoor unit in the warming stage, the same superheat degree as in the cooling stage are adopted to control, for example, 1° C.

is adopted. At this time, for the indoor unit in the warming stage, it does not need such a low superheat degree, since such a low superheat degree corresponds to a larger opening degree of the electronic expansion valve, and large cooling capacity is transported, which may lead to unnecessary energy consumption, and may cause the temperature to further drop and reduce the user's temperature comfort, thus the fixed superheat degree does not match the actual operation requirement of the indoor unit in the warming stage. Therefore, in order to make the superheat degree match the actual operation requirement of the indoor unit in the warming stage, the superheat degree should be changeable.

In addition to the above-mentioned several operating stages, the indoor unit can also be divided into other stages. For example, the stage from entering the warming stage until the VRF air conditioner is shut down is regarded as the load matching stage. In this stage, the operating status of the VRF air conditioner can be changed according to the indoor ambient temperature, such as, shutting down some indoor units and their corresponding electronic expansion valves to achieve energy saving effects.

In order to match the actual operation requirements of the indoor unit in the warming stage with the superheat degree, the target superheat degree is determined based on the working condition parameters of the target indoor unit, so that the target superheat degree changes as the working condition parameters of the target indoor unit change. The working condition parameters are parameters that describe the working conditions of the indoor unit. The working condition parameters include environmental parameters and operating status. The environmental parameters include, such as, indoor ambient temperature, outdoor ambient temperature, etc., and the operating status include. Such as, capacity requirements, evaporation temperature, etc. The corresponding relationship between different working condition data and the superheat degree can be preset, and based on the correspondence, the superheat degree corresponding to the working condition parameter is obtained. For the target indoor unit in the warming stage, the target superheat degree shows an increasing trend as the working condition parameters change. For example, after entering the warming stage, as the working condition parameters change, the initial superheat degree is 2° C., and then the superheat degree gradually increases to 4° C., 6° C., and 8° C. Correspondingly, the opening degree of the electronic expansion valve decreases. The transported cooling capacity is reduced. Since it is already in the warming stage at this time, it does not require much cooling capacity, so that the actual operation requirement of the indoor unit matches the superheat degree.

When determining the target superheat degree based on the working condition parameters of the target indoor unit, the following method can be adopted: determining the ratio of the actual capability requirement to a rated nominal capability according to the working condition parameter, determining the capacity requirement ratio of the target indoor unit, and determining the target superheat degree according to the indoor ambient temperature, the outdoor ambient temperature of the environment where the target indoor unit is located, and the target evaporation temperature of the target indoor unit. When implemented, a mathematical fitting relationship between the target superheat degree and the capacity requirement ratio, the indoor ambient temperature and the outdoor ambient temperature of the environment where the target indoor unit is located and the target evaporation temperature of the target indoor unit can be constructed, so as to calculate the target superheat degree based on the mathematical fitting relationship. It can further combine the preset correction value of the target superheat degree, the capacity requirement ratio, the indoor ambient temperature and the outdoor ambient temperature of the environment where the target indoor unit is located, the target evaporation temperature of the target indoor unit, and the target superheat degree to construct the mathematical fitting relationship. The target superheat degree can be determined according to the mathematical fitting relationship, the capacity requirement ratio and the target superheat degree are positively correlated. When implemented, the target superheat degree can also be obtained based on the mathematical relationship or mapping relationship between other working condition parameters and superheat degree, where:

the actual capacity requirement, also known as instantaneous capacity requirement, instantaneous capacity requirement refers to the room's capacity requirement for the target indoor unit at a certain moment, which is obtained by adding the instantaneous cooling load and the sensible heat load to be moved. The instantaneous cooling load refers to the heat required to be taken from the room in order to maintain the indoor ambient temperature at a certain moment. The sensible heat load to be removed refers to the cooling load generated by the sensible heat to be removed in order to drop the indoor ambient temperature at a certain moment to the set temperature of the indoor unit. The instantaneous cooling load can be calculated as following formula:

$$Q_{load}=f(K_{walb}K_{floor},L,H,T0,T1,T4)$$

$K_{wall}$ represents the overall heat transfer coefficient of the wall, for example, it can be taken as 1.95 W/(m$^2$·K), $K_{floor}$ represents the overall heat transfer coefficient of the roof and the bottom, for example, it can be taken as 3.13 W/(m$^2$·K). $F_{wall}$ represents the heat transfer area of the wall, $F_{wall}$=, $F_{floor}$ represents the heat transfer of the roof and the bottom Area, $F_{floor}$=, L represents the side length of the standard room (the ground is regarded as a square) where the indoor unit is located. The default for a 3-horse unit is L=7 m, H=2.8 m, the default for a 2-horse unit is L=5.5 m, H=2.8 m, and the default for a 1-horse unit is L=4 m, H=2.8 m. The unit of instantaneous cooling load is kW, TO represents the initial temperature of the room when starting, T1 represents the indoor ambient temperature, the unit is ° C., T4 represents the outdoor ambient temperature, and the unit is ° C.

The sensible heat load to be removed can be calculated as the following formula:

$$Q_{sensible}=\frac{mC_p(T_1-T_s)}{\tau}$$

m represents the mass of the air in the standard room, the unit is kg, $C_p$ represents the specific heat capacity of the air in the standard room, which is taken as 1.005 kJ/(kg·K), and τ represents the time constant, which is taken as 100 s.

The operating parameters refer to the operating parameters of the electronic expansion valve, such as, operating opening degree and operating duration. After obtaining the target superheat degree, the operating parameters of the electronic expansion valve of the target indoor unit are adjusted based on the target superheat degree. When adjusting, the basic adjustment principle is that the greater the target superheat degree, the smaller the operating opening degree. Based on this, different implementation methods can be adopted, including but not limited to the following methods:

determining an actual superheat degree of the target indoor unit according to a difference between an outlet temperature of a heat exchanger of the target indoor unit and a middle temperature of the heat exchanger, and the difference between the actual superheat degree and the target superheat degree is further determined. Based on the difference, the operating opening degree and operating duration of the electronic expansion of the target indoor unit are determined. When determining the operating opening degree and operating duration of the electronic expansion valve of the target indoor unit based on the difference, the preset adjustment interval where the difference is located can be determined. For example, when the difference is 5° C., it is determined that the preset adjustment interval where the difference is located is the interval of "above 4° C.", and the corresponding opening adjustment value is +10, that is, based on the original operating opening degree, the original operating opening degree is increased by 10 to obtain the operating opening degree of the electronic expansion valve. When the interval is "above 4° C.", the corresponding operating duration is 30 s. For another example, when the difference is 3° C., it is determined that the preset adjustment interval where the difference lies is [2, 4), that is, "the interval greater than or equal to 2° C. and less than 4° C.". At this time, the corresponding opening adjustment value of the electronic expansion valve is +6, that is, based on the original operating opening degree, the original operating opening degree is increased by 6 to obtained the operating opening degree of the electronic expansion valve. When the interval is [2, 4), the corresponding operating duration is 60 s. When the difference is 0° C., the corresponding preset adjustment interval is "equal to 0", the corresponding adjustment value is 0, that is, the original operating opening degree is maintained as the operating opening degree of the electronic expansion valve, and the operating duration is 120 s. When the difference is −1° C., the corresponding preset adjustment interval is [−1,0), the corresponding opening adjustment value is −2, that is, the original operating opening degree is reduced by 2 to obtain the operating opening degree of the electronic expansion valve, the corresponding operating duration is 120 s. It can be seen from the above example that the larger the difference, the larger the opening adjustment value corresponding to the preset adjustment interval may be, thereby increasing the operating opening degree of the electronic expansion valve. On this basis, since the difference is the difference between the actual superheat degree and the target superheat degree, assuming that the actual superheat degree is the same value, as the target superheat degree increases, the difference decreases, and the corresponding operating opening degree of the electronic expansion valve will also decrease, so that as the target superheat degree increases, the operating opening degree of the electronic expansion valve decreases. Therefore, the operating opening degree of the electronic expansion valve matches the target superheat degree, further making the actual operation requirement of the indoor unit match the superheat degree.

In order to improve the heat exchange effect of the heat exchanger and achieve energy saving effect, regularly detection can also be made on the outlet temperature of the outdoor heat exchanger of the target indoor unit after obtaining the target indoor unit in the warming stage among the started indoor units. The speed of the outdoor fan of the target indoor unit can be adjusted according to the outlet temperature. For example, detect the outlet temperature at a preset time interval. The preset time interval is, for example, 30 seconds, and determine the interval corresponding to the outlet temperature. For example, if the outlet temperature is greater than 30° C., then increase the speed of the outdoor fan. If the outlet temperature is less than or equal to 30° C. and greater than or equal to 15° C., maintain the current speed of the outdoor fan. If the outlet temperature is less than or equal to 15° C. and greater than 7° C., reduce the fan speed. If the outlet temperature is less than or equal to 7° C., the air supply will be stopped and the outdoor fan speed will be set to zero. When the temperature is high, the outdoor fan speed will be increased to improve the heat exchange effect. When the outdoor fan temperature is low, the outdoor fan speed will be reduced to save energy.

In this embodiment, by obtaining the target indoor unit in the warming stage among the started indoor units, the target superheat degree is determined according to the working condition parameters of the target indoor unit, and the operation parameters of the electronic expansion valve of the target indoor unit is adjusted according to the target superheat degree. When the target indoor unit is in the warming stage, in order to avoid the problem of mismatching the actual operation requirements of the indoor unit caused by adopting the same fixed superheat degree in the cooling stage, the target superheat degree is determined through the working condition parameters of the target indoor unit. As the specific information in the working condition parameters of the indoor unit changes during the warming stage, the target superheat degree changes accordingly, and the operating parameters of the electronic expansion valve are adjusted based on the target superheat degree, since the working condition parameters can reflect the actual operation requirements of the indoor unit, the target superheat degree obtained based on the working condition parameters meets the actual operation requirements of the indoor unit. When adjusting the electronic expansion valve of the target indoor unit based on the target superheat degree, the superheat degree is matched with the actual operation requirement of the indoor units.

Figure 3:
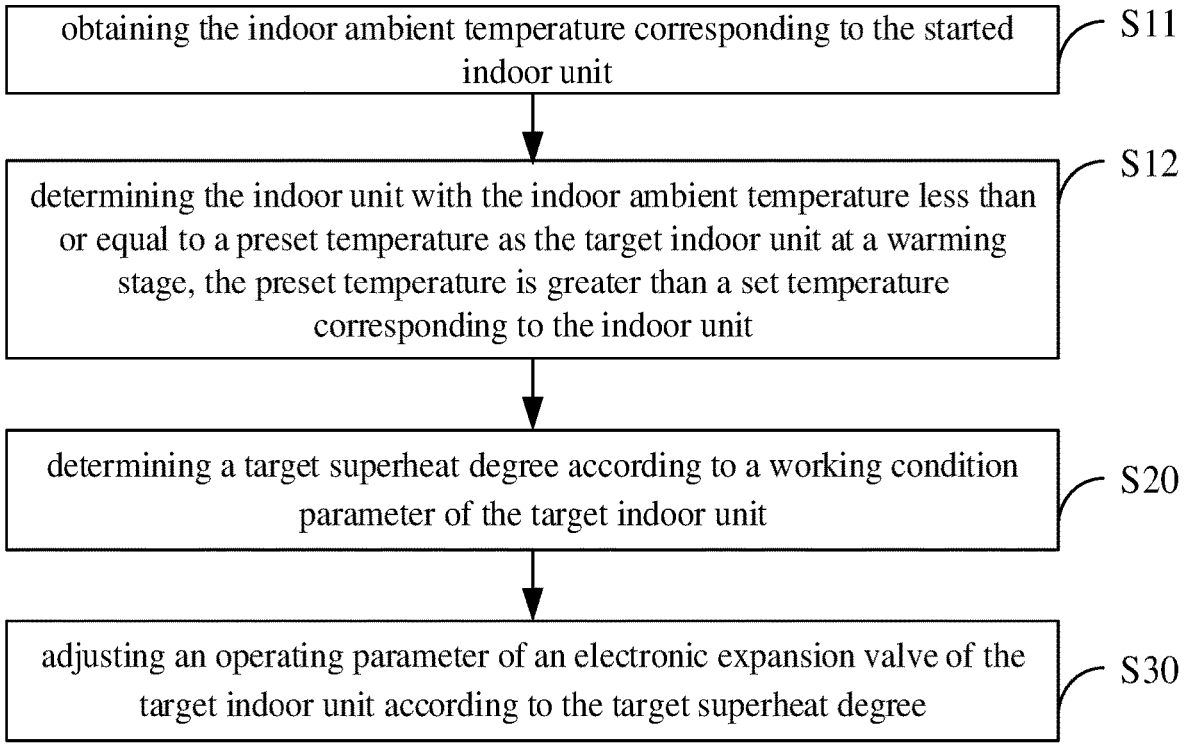
FIG. 3 is a schematic flowchart of the method for controlling the VRF air conditioner according to another embodiment of the present application.

In another embodiment, as shown in FIG. 3, based on the above embodiment of FIG. 2, this embodiment provides that step S10 includes:

Step S11, obtaining the indoor ambient temperature corresponding to the started indoor unit.

Step S12, determining the indoor unit with the indoor ambient temperature less than or equal to a preset temperature as the target indoor unit at a warming stage, the preset temperature is greater than a set temperature corresponding to the indoor unit.

When obtaining the target indoor unit in the warming stage, in order to achieve the technical energy saving effect, in this embodiment, by obtaining the indoor ambient temperature of the environment where the started indoor unit is located, the indoor ambient temperature is less than or equal to the preset temperature. As a target indoor unit in the warming stage, the preset temperature is greater than the corresponding set temperature of the indoor unit. For example, if the set temperature is 26° C., when the indoor ambient temperature reaches 26° C., the corresponding indoor unit is used as the indoor unit in the warming stage. For example, the indoor ambient temperature was 30° C. before, when it drops from 20° C. to 26° C., the corresponding indoor unit is used as the indoor unit in the warming stage. Relatively, in this embodiment, the corresponding indoor unit will not be used as the indoor unit in the warming stage when the set temperature is reached. Instead, the corresponding indoor unit will be used as the target indoor unit in the warming stage when the preset temperature is reached. The preset temperature is greater than the set temperature. For example, if the set temperature is 26° C. and the preset temperature is 27° C., then when the indoor ambient temperature drops from 30° C. to 27° C., it can be determined that the corresponding indoor unit is in the warming stage. The target indoor unit further determines the target superheat degree based on the working condition parameters. When determining the target superheat degree based on the working condition parameters, since the indoor ambient temperature is close to the set temperature, the target superheat degree is generally large, and the transported cooling capacity at this time is small, so that the energy saving effect can be achieved. In addition, since after entering the warming stage, the cooling capacity is reduced but does not directly stop transmitting, a small amount of cooling capacity can still be used to further reduce the indoor ambient temperature to the set temperature. Based on this, the following technical effects are further achieved. Since the exemplary technology is that entering the warming stage when the indoor ambient temperature reaches the set temperature, at this time, since the transportation of cooling capacity to the room cannot be stopped immediately, the indoor ambient temperature in the room is actually lower than the set temperature, the user's temperature comfort may be reduced due to the indoor ambient temperature being too low. In contrast, in this embodiment, the warming stage is entered when the preset temperature is reached, which is equivalent to entering in advance. In the warming stage, since the transportation of cooling capacity to the room does not stop immediately, the temperature can be further reduced, but not too much, thereby improving the user's temperature comfort. For example, the set temperature is 24° C., if entering the warming stage when it reaches 24° C. Since it cannot directly stop transmitting cooling capacity into the room, the temperature further drops to 23° C. At this time, the user feels the temperature and the comfort are low. However, entering the warming stage when the preset temperature of 25° C. is reached, since it does not directly stop transmitting cooling capacity into the room, the temperature further drops to 24° C., thus avoiding the problem of low user comfort caused by transporting cooling capacity into the room after entering the warming stage.

In this embodiment, the preset temperature is limited to be greater than the corresponding set temperature of the indoor unit. It can be understood that the preset temperature is at least used to indicate the timing of entering the warming stage in advance to achieve energy saving effects. Based on this, a reasonable preset temperature can be set to meet energy saving needs. When specifically setting the preset temperature, each set temperature can be associated with the preset temperature, or a preset correction value can be set, and the correction value can be added to the set temperature to get the preset temperature. For example, the correction value is PC and the set temperature is 26° C., the preset temperature can be obtained as 26+1=27° C. The correction value can also be set to other values. There is no restriction on the specific setting data of the correction value. However, it can be understood that if the correction value is set too small, for example, set to 0.01, then, for example, the set temperature is 26° C., and the preset temperature is 26+0.01=26.01. At this time, since 26.01 is too close to 26, the actual energy saving effect is not obvious. Therefore, in practical applications, the impact of different correction values on energy saving can be measured based on specific experiments, and reasonable correction values and reasonable preset temperatures can be set. In addition, the difference between the preset temperature and the set temperature can be measured based on specific experiments. It should be noted that the preset temperature needs to be set reasonably. If the preset temperature is too high, the warming stage will be entered too early, making it impossible to reach the set temperature in time, and thus reducing user comfort. If the preset temperature is too low, the energy saving effect will not be obvious, and the user comfort will also be reduced. Therefore, the different differences between the preset temperature and the set temperature can be measured separately, and the energy saving effect and user comfort experience can be measured for different differences, and a specific difference can be selected. Based on this, a preset temperature that improves the energy saving effect and improves user comfort is obtained. For example, the difference between the preset temperature and the set temperature is respectively set to 0.1° C., 0.2° C., 0.3° C., 0.4° C., 0.5° C., 0.6° C., 0.7° C., 0.8° C., 0.9° C., and 1° C. The user comfort and energy saving effect corresponding to different differences are respectively measured. For example, the user comfort is evaluated by indexes of hot and cold sensation, the energy saving effect can be evaluated by an index of the consumption change to select the appropriate difference value, and the difference value is saved as the correction value. When obtaining the target indoor unit in the warming stage, the preset temperature can be calculated based on the saved correction value and the set temperature, that is, the sum of the set temperature and the correction value is the preset temperature. Based on this, the indoor unit with the indoor ambient temperature greater than the set temperature is further used as the target indoor unit in the warming stage.

In order to further improve the energy saving effect of the VRF air conditioner, in the embodiment, after the adjusting the electronic expansion valve of the target indoor unit according to the target superheat degree, and in response to determining that the current indoor ambient temperature is within a preset temperature range, closing the electronic expansion valve of the target indoor unit to achieve the energy saving effect. The current indoor ambient temperature is the currently detected indoor ambient temperature. Since the electronic expansion valve of the target indoor unit has been adjusted according to the target superheat degree, the current indoor ambient temperature at this time may have been close to the set temperature. In order to determine whether it is close to the set temperature, a preset temperature interval can be used to represent the set temperature. The set temperature is within the preset temperature interval, and the temperature interval is obtained according to the set temperature. The preset temperature interval actually includes the error range of the set temperature. For example, if the set temperature is 26° C., assuming that the error range is within 0.1° C., the preset temperature interval is [25.9, 26.1]. The error range of the set temperature can be set in advance, such as, directly setting it to 0.1° C., and the preset temperature interval can be determined based on the error range and the set temperature.

In order to further improve the energy saving effect of the VRF air conditioner, in the embodiment, after the adjusting the operating parameter of the electronic expansion valve of the target indoor unit according to the target superheat degree, when the current indoor ambient temperature of all started indoor units is within the corresponding preset temperature interval, the started VRF air conditioner is controlled to standby to achieve the energy saving effect. After the started VRF air conditioner is standby, the capacity requirements of all indoor units are also determined. When there are indoor units with capacity requirements, return to the step of obtaining the indoor ambient temperature corresponding to the started indoor unit and the subsequent steps to further control the VRF air conditioner. Each indoor unit corresponds to a preset temperature range, that is, when determining whether the current indoor ambient temperature is within the preset temperature range, since different indoor units may be in different rooms, their current ambient temperatures are different, and the set temperatures are also different, the corresponding preset temperature intervals are also different. Based on this, it is further necessary to determine the preset temperature interval corresponding to each indoor unit, and the temperature interval is obtained according to the corresponding set temperature. The set temperature, preset temperature interval and indoor unit correspond to each other. In other words, each indoor unit has its corresponding set temperature and preset temperature interval, and the same indoor unit is obtained according to the set temperature of the same indoor unit. The preset temperature interval can be calculated using the sum of the aforementioned correction value and the set temperature. For example, there are three indoor units, namely A, B, and C, the set temperatures correspond to 23° C., 26° C., and 26° C. sequentially, and the corresponding preset temperature intervals correspond to [22.9, 23.1], [25.9, 26.1], [25.9, 26.1] in sequence.

After controlling the standby of the VRF air conditioner, in order to avoid the problem of low user comfort caused by continuous standby, the embodiment also determines the capacity requirements of all indoor units. When there are indoor units with capacity requirements, the execution returns to the step of obtaining the indoor ambient temperature corresponding to the started indoor unit and the subsequent steps to adjust the operating status of the VRF air conditioner. The following methods can be used to determine the indoor units with capacity requirements: determining a cold load and a sensible heat load corresponding to each indoor unit, wherein the cold load is heat carried away from a room required to maintain the indoor ambient temperature, and the sensible heat load is a cold load generated by removing sensible heat through reducing the indoor ambient temperature. In addition, the cooling load is calculated in the same way as the instantaneous cooling load, the sensible heat load is calculated in the same way as the sensible heat load to be removed.

When the sum of the cold load and the sensible heat load is greater than zero, it indicates that the corresponding indoor unit has the capability requirement. In addition, if the indoor ambient temperature has reached the set temperature after the indoor unit is started, the indoor unit has no capacity requirement at this time. In addition, the indoor unit that is not started has no capacity requirement.

In this embodiment, by obtaining an indoor ambient temperature of an environment where the started indoor units are located, determining the indoor unit with the indoor ambient temperature less than or equal to a preset temperature as the target indoor unit at a warming stage, the preset temperature is greater than a set temperature corresponding to the indoor unit, so that the indoor unit can enter the warming stage before reaching the set temperature. Since the target superheat degree of the indoor unit in the warming stage is determined according to the working condition parameters, when the working condition parameters change, since the indoor ambient temperature has been close to the set temperature, the target superheat degree is generally large. At this time, small cooling capacity is transported, which can achieve the energy saving effect.

Figure 4:
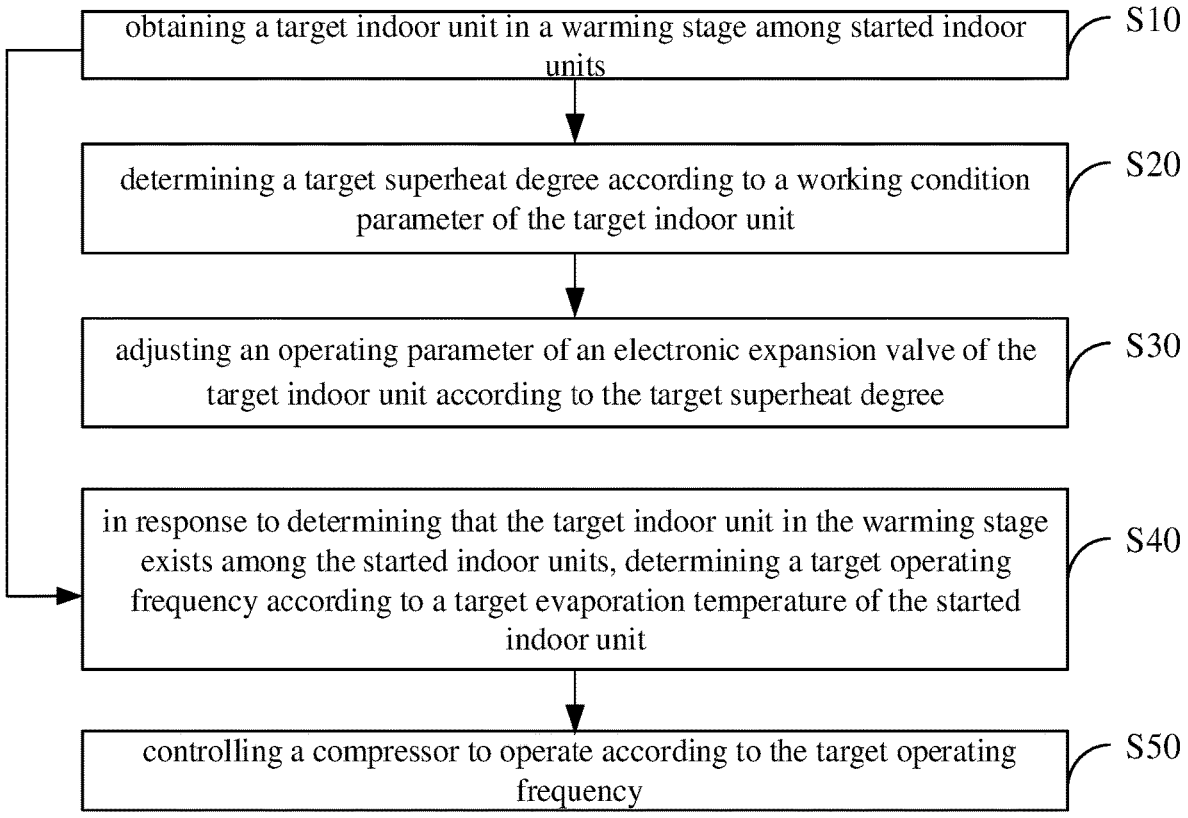
FIG. 4 is a schematic flowchart of the method for controlling the VRF air conditioner according to still another embodiment of the present application.

In another embodiment, as shown in FIG. 4, based on the embodiment shown in FIG. 2, this embodiment provides that the method for controlling the VRF air conditioner further includes:

Step S40, in response to determining that the target indoor unit in the warming stage exists among the started indoor units, determining a target operating frequency according to a target evaporation temperature of the started indoor unit;

Step S50, controlling a compressor to operate according to the target operating frequency.

In order to further achieve the energy saving effect of the VRF air conditioner, in this embodiment, when it is detected that the target indoor unit is in the warming stage among the started indoor units, the target operating frequency is also determined according to the target evaporation temperature of the started indoor unit. The compressor is controlled to operate according to the target operating frequency to achieve frequency conversion control and save energy.

When there is at least one target indoor unit in the warming stage among all the started indoor units, it is determined that there is a target indoor unit in the warming stage among the started indoor units.

When determining the target operating frequency, the following methods can be used: obtaining the target evaporation temperature of all started indoor units, determining the minimum target evaporation temperature among all target evaporation temperatures, determining an average value of the central temperatures of the heat exchangers of all the started indoor units, determining a difference between the average value and the minimum target evaporation temperature, and determining the target operating frequency corresponding to the difference. The target evaporation temperature is calculated as the following formula:

$$T_{2,target}=a*f(Q_{req},Q_{rated},T_1,T_4)+k2$$

$T_{2,target}$ represents the target evaporation temperature, the unit is ° C. $Q_{req}$ represents the instantaneous capacity requirement, the unit is kW. $Q_{rated}$ represents the rated nominal capacity of the indoor unit, the unit is kW. $T_1$ represents the indoor ambient temperature, the unit is ° C. $T_4$ represents the outdoor ambient temperature, the unit is ° C. k2 represents the real-time correction parameter of the target evaporation temperature.

When determining the target operating frequency corresponding to the difference between the average value and the minimum target evaporation temperature, the interval where the difference is located can be determined, and the frequency adjustment value and the action cycle are determined according to the interval where the difference is located. The target operating frequency is determined according to the frequency adjustment value and the current operating frequency, for example, the sum of the frequency adjustment value and the current operating frequency are used as the target operating frequency. The action cycle is the length of time to maintain a certain frequency, for example, if the difference is −4° C., the interval where the difference is located is "the interval less than −3° C.", the frequency adjustment value corresponding to the interval is −5 Hz, then the target operating frequency can be obtained according to the current actual operating frequency and the frequency adjustment value. For example, if the difference is −1, the interval where the difference is located is [−1, 1), and the corresponding frequency adjustment value is 0 Hz.

On the basis of determining the target operating frequency, the length of time of operating at the target operating frequency can be further determined by: determining the interval where the difference between the average value and the minimum target evaporation temperature is located, and determining the action cycle corresponding to the interval where the difference is located. For example, the difference is −4° C., the interval where the difference is located is "the interval less than −3° C.", and the action cycle corresponding to the interval is 30 s. For another example, the difference is −1, the interval where the difference is located is [−1, 1), the corresponding action cycle is 180 s.

After determining the target operating frequency and action cycle, the compressor can be controlled to operate a corresponding action cycle according to the target operating frequency.

In this embodiment, when it is detected that there is a target indoor unit in the warming stage among the started indoor units, the target operating frequency is determined according to the target evaporation temperature of the started indoor unit, and the compressor is controlled to operate according to the target operating frequency, so that the operating frequency of the compressor can be changed based on the target evaporation temperature. When there is a target indoor unit in the warming stage, it does not need to operate at the original operating frequency. At this time, the target operating frequency determined according to the target evaporation temperature is low, thus achieving the energy saving effect.

It should be understood that, in the present application, the terms "including", "includes" or any other variants are used for covering non-exclusive contents, so that a series of processes, methods, items are all incorporated herein. Or the system not only includes those elements, but also includes other elements that are not clearly listed, or further includes the elements inherent in the process, the method, the item or the system. Without more restrictions, the elements limited by the description "include one . . . " are not intended to exclude additional same elements in the process, the method, the item, or the systems.

The serial numbers of the present application are only for description, and do not represent the advantages and disadvantages of the embodiments.

Through the above description of the embodiments, those skilled in the art can understand that the above embodiments can be implemented by instructing the software and the general hardware platform, and can also be implemented by the hardware. In many cases, the former is better for implementation. Based on this understanding, the essence or the part contributing to the related art of the technical solutions of the present application can be embodied in the form of a software product. The computer software product can be stored in the computer-readable storage medium (such as, a read-only memory (ROM) or a random-access memory (RAM), a disk, and an optical disk) as mentioned above, and may include several instructions to cause a VRF air conditioner to execute the methods described in the various embodiments of the present application.

The above-mentioned embodiments are only some embodiments of the present application, and are not intended to limit the scope of the present application. Any equivalent structure conversion or equivalent process conversion made with reference to the description and the accompanying drawings of the present application, directly or indirectly applied in other related technical fields, should all fall in the scope of the present application.

What is claimed is:

1. A method for controlling a variable refrigerant flow (VRF) air conditioner, comprising:

obtaining set temperatures and indoor ambient temperatures of respective environments where a plurality of indoor units of the VRF air conditioner that have started are located;

identifying a target indoor unit of the plurality of indoor units that is in a warming stage based on the indoor ambient temperature of the environment of the target indoor unit being less than or equal to a preset temperature, wherein the preset temperature is greater than the set temperature for the environment of the target indoor unit;

determining a target superheat degree according to a working condition parameter of the target indoor unit; and adjusting an operating parameter of an electronic expansion valve of the target indoor unit according to the target superheat degree.

2. The method for controlling the VRF air conditioner according to claim 1, wherein, after the adjusting the operating parameter of the electronic expansion valve of the target indoor unit according to the target superheat degree, the method further comprises:

obtaining a current indoor ambient temperature of the environment of the target indoor unit; and in response to determining that the current indoor ambient temperature is within a preset temperature range, closing the electronic expansion valve of the target indoor unit, wherein the set temperature of the target indoor unit is within the preset temperature range, and the preset temperature range is based on the set temperature.

3. The method for controlling the VRF air conditioner according to claim 1, wherein, after the adjusting the operating parameter of the electronic expansion valve of the target indoor unit according to the target superheat degree, the method further comprises:

obtaining current indoor ambient temperatures of the environments where the plurality of indoor units are located;

in response to determining that the current indoor ambient temperatures of the environments where the plurality of indoor units are located are within corresponding preset temperature ranges that include, and are based on, set temperatures for the environments, controlling the VRF air conditioner to standby;

determining whether each of the plurality of indoor units has a capability requirement; and in response to determining that the target indoor unit has the capability requirement, obtaining the current indoor ambient temperature of the environment where the target indoor unit is located.

4. The method for controlling the VRF air conditioner according to claim 3, wherein the determining whether each of the plurality of indoor units has the capability requirement comprises, for each of the plurality of indoor units:

determining a cold load and a sensible heat load corresponding to the respective indoor unit, wherein the cold load is heat carried away from an environment where the respective indoor unit is located that is required to maintain the indoor ambient temperature for the environment where the respective indoor unit is located, and the sensible heat load is a cold load generated by removing sensible heat through reducing the indoor ambient temperature for the environment where the respective indoor unit is located; and determining that the respective indoor unit has the capability requirement based on a sum of the cold load and the sensible heat load for the respective indoor unit being greater than zero.

5. The method for controlling the VRF air conditioner according to claim 1, wherein the determining the target superheat degree according to the working condition parameter of the target indoor unit comprises:

determining a capability requirement ratio of the target indoor unit comprising a ratio of an actual capability requirement of the target indoor unit to a rated nominal capability of the target indoor unit; and determining the target superheat degree according to the capability requirement ratio, the indoor ambient temperature of the environment where the target indoor unit is located, an outdoor ambient temperature, and a target evaporation temperature of the target indoor unit, wherein the target superheat degree is positively correlated with the capability requirement ratio.

6. The method for controlling the VRF air conditioner according to claim 1, wherein the adjusting the operating parameter of the electronic expansion valve of the target indoor unit according to the target superheat degree comprises:

determining an actual superheat degree of the target indoor unit according to a difference between an outlet temperature of a heat exchanger of the target indoor unit and a middle temperature of the heat exchanger;

determining an operating opening degree and an operating duration of the electronic expansion valve of the target indoor unit according to the difference between the actual superheat degree and the target superheat degree; and controlling the electronic expansion valve of the target indoor unit to operate for the operating duration according to the operating opening degree.

7. The method for controlling the VRF air conditioner according to claim 1, further comprising:

determining a target operating frequency according to a target evaporation temperature of the target indoor unit; and controlling a compressor to operate according to the target operating frequency.

8. The method for controlling the VRF air conditioner according to claim 7, wherein the determining the target operating frequency according to the target evaporation temperature of the target indoor unit comprises:

determining respective target evaporation temperatures of the plurality of indoor units;

obtaining a minimum target evaporation temperature of the target evaporation temperatures;

determining respective central temperatures of heat exchangers of the plurality of indoor units;

determining an average value of the central temperatures;

determining a difference between the average value of the central temperatures and the minimum target evaporation temperature; and determining the target operating frequency based on the difference between the average value of the central temperatures and the minimum target evaporation temperature.

9. The method for controlling the VRF air conditioner according to claim 1, wherein after the identifying the target indoor unit of the plurality of indoor units that is in the warming stage, the method further comprises:

periodically detecting an outlet temperature of an outdoor heat exchanger of the target indoor unit; and adjusting a rotating speed of an outdoor fan of the target indoor unit according to the outlet temperature.

10. The method for controlling the VRF air conditioner according to claim 1, wherein the target indoor unit is operating in a cooling mode.

11. A controller for a variable refrigerant flow (VRF) air conditioner comprising:

one or more processors; and a memory storing a program for controlling the VRF air conditioner, wherein the program is executable by the one or more processors to implement a method comprising:

obtaining set temperatures and indoor ambient temperatures of respective environments where a plurality of indoor units of the VRF air conditioner that have started are located;

identifying a target indoor unit of the plurality of indoor units that is in a warming stage based on the indoor ambient temperature of the environment of the target indoor unit being less than or equal to a preset temperature, wherein the preset temperature is greater than the set temperature for the environment of the target indoor unit;

determining a target superheat degree according to a working condition parameter of the target indoor unit; and adjusting an operating parameter of an electronic expansion valve of the target indoor unit according to the target superheat degree.

12. The controller of claim 11, wherein the method further comprises, after the adjusting the operating parameter of the electronic expansion valve of the target indoor unit according to the target superheat degree:

obtaining current indoor ambient temperatures of the environments where the plurality of indoor units are located;

in response to determining that the current indoor ambient temperatures of the environments where the plurality of indoor units are located are within corresponding preset temperature ranges that include, and are based on, set temperatures for the environments, controlling the VRF air conditioner to standby; and in response to determining that the target indoor unit has a capability requirement, returning to obtain the current indoor ambient temperature of the environment where the target indoor unit is located.

13. A variable refrigerant flow (VRF) air conditioner system comprising:

at least one outdoor unit;

a plurality of indoor units; and a controller comprising:

one or more processors; and a memory comprising instructions that, when executed by the one or more processors causes the one or more processors to, when the plurality of indoor units have been started and are operating in a cooling mode:

obtain set temperatures and indoor ambient temperatures of respective environments where the plurality of indoor units are located;

identifying a target indoor unit of the plurality of indoor units that is in a warming stage based on the indoor ambient temperature of the environment of the target indoor unit being less than or equal to a preset temperature, wherein the preset temperature is greater than the set temperature for the environment of the target indoor unit;

determining a target superheat degree according to a working condition parameter of the target indoor unit; and adjusting an operating parameter of an electronic expansion valve of the target indoor unit according to the target superheat degree.

14. The VRF air conditioner system of claim 13, wherein the instructions further cause the processor to, after adjusting the operating parameter of the electronic expansion valve of the target indoor unit according to the target superheat degree:

obtain current indoor ambient temperatures of the environments where the plurality of indoor units are located;

in response to a determination that the current indoor ambient temperatures of the environments where the plurality of indoor units are located are within corresponding preset temperature ranges that include, and are based on, set temperatures for the environments, controlling the VRF air conditioner to standby; and in response to a determination that the target indoor unit has a capability requirement, return to obtain the current indoor ambient temperature of the environment where the target indoor unit is located.

* * * * *